US008190312B2

(12) United States Patent
Nandedkar et al.

(10) Patent No.: US 8,190,312 B2
(45) Date of Patent: May 29, 2012

(54) SYSTEM AND METHOD FOR DETERMINING A QUALITY OF A LOCATION ESTIMATION OF A POWERED SYSTEM

(75) Inventors: Vishram Vinayak Nandedkar, Karnataka (IN); Ajith Kuttannair Kumar, Erie, PA (US)

(73) Assignee: General Electric Company, Schenectady, NY (US)

( * ) Notice: Subject to any disclaimer, the term of this patent is extended or adjusted under 35 U.S.C. 154(b) by 1112 days.

(21) Appl. No.: 12/047,496

(22) Filed: Mar. 13, 2008

(65) Prior Publication Data

US 2009/0234523 A1 Sep. 17, 2009

(51) Int. Cl.
*G01C 21/12* (2006.01)

(52) U.S. Cl. ..... 701/19; 701/216

(58) Field of Classification Search ..... 701/19, 701/20, 200, 207, 213, 214, 216, 217, 220; 342/357.3, 357.32

See application file for complete search history.

(56) References Cited

U.S. PATENT DOCUMENTS

| | | | |
|---|---|---|---|
| 3,519,805 | A | 7/1970 | Thorne-Booth |
| 3,650,216 | A | 3/1972 | Harwick et al. |
| 3,655,962 | A | 4/1972 | Koch |
| 3,865,042 | A | 2/1975 | DePaola et al. |
| 4,005,838 | A | 2/1977 | Grundy |
| 4,041,283 | A | 8/1977 | Mosier |
| 4,042,810 | A | 8/1977 | Mosher |
| 4,181,943 | A | 1/1980 | Mercer, Sr. et al. |
| 4,253,399 | A | 3/1981 | Spigarelli |
| 4,279,395 | A | 7/1981 | Boggio et al. |
| 4,344,364 | A | 8/1982 | Nickles et al. |
| 4,401,035 | A | 8/1983 | Spigarelli et al. |
| 4,561,057 | A | 12/1985 | Haley, Jr. et al. |
| 4,602,335 | A | 7/1986 | Perlmutter |
| 4,711,418 | A | 12/1987 | Aver, Jr. et al. |
| 4,735,385 | A | 4/1988 | Nickles et al. |
| 4,794,548 | A | 12/1988 | Lynch et al. |
| 4,827,438 | A | 5/1989 | Nickles et al. |
| 4,853,883 | A | 8/1989 | Nickles et al. |
| 5,109,343 | A | 4/1992 | Budway |
| 5,398,894 | A | 3/1995 | Pascoe |
| 5,437,422 | A | 8/1995 | Newman |
| 5,440,489 | A | 8/1995 | Newman |
| 5,676,059 | A | 10/1997 | Alt |
| 5,744,707 | A | 4/1998 | Kull |

(Continued)

FOREIGN PATENT DOCUMENTS

| | | |
|---|---|---|
| EP | 1 297 982 | 4/2003 |

*Primary Examiner* — S. Joseph Morano
*Assistant Examiner* — Zachary Kuhfuss
(74) *Attorney, Agent, or Firm* — GE Global Patent Operation; John A. Kramer

(57) ABSTRACT

A system is provided for determining a quality of a location estimation of a powered system at a location. The system includes a first sensor configured to measure a first parameter of the powered system at the location. The system further includes a second sensor configured to measure a second parameter of the powered system at the location. The system further includes a second controller configured to determine the location estimation of the powered system and the quality of the location estimation, based upon a first location of the powered system based on the first parameter, and a second location of the powered system based on the second parameter of the powered system. A method is also provided for determining a quality of a location estimation of a powered system at a location.

27 Claims, 6 Drawing Sheets

U.S. PATENT DOCUMENTS 5,758,299 A 5/1998 Sandborg et al.
5,785,392 A 7/1998 Hart
5,828,979 A 10/1998 Polivka et al.
5,950,967 A 9/1999 Montgomery
6,112,142 A 8/2000 Shockley et al.
6,125,311 A 9/2000 Lo
6,144,901 A 11/2000 Nickles et al.
6,226,591 B1 * 5/2001 Okumura et al. ..... 701/216
6,268,804 B1 7/2001 Janky et al.
6,269,034 B1 7/2001 Shibuya
6,308,117 B1 10/2001 Ryland et al.
6,456,937 B1 9/2002 Doner et al.
6,487,488 B1 11/2002 Peterson, Jr. et al.
6,490,523 B2 12/2002 Doner
6,505,103 B1 1/2003 Howell et al.
6,516,727 B2 2/2003 Kraft
6,591,758 B2 7/2003 Kumar
6,609,049 B1 8/2003 Kane et al.
6,612,245 B2 9/2003 Kumar et al.
6,612,246 B2 9/2003 Kumar
6,615,118 B2 9/2003 Kumar
6,641,090 B2 11/2003 Meyer
6,691,957 B2 2/2004 Hess, Jr. et al.
6,694,231 B1 2/2004 Rezk
6,732,023 B2 5/2004 Sugita et al.
6,763,291 B1 7/2004 Houpt et al.
6,789,005 B2 9/2004 Hawthorne
6,810,312 B2 10/2004 Jammu et al.
6,824,110 B2 11/2004 Kane et al.
6,845,953 B2 1/2005 Kane et al.
6,853,888 B2 2/2005 Kane et al.
6,856,865 B2 2/2005 Hawthorne
6,863,246 B2 3/2005 Kane et al.
6,865,454 B2 3/2005 Kane et al.
6,903,658 B2 6/2005 Kane et al.
6,915,191 B2 7/2005 Kane et al.
6,922,619 B2 7/2005 Baig et al.
6,957,131 B2 10/2005 Kane et al.
6,978,195 B2 12/2005 Kane et al.
6,980,894 B1 12/2005 Gordon et al.
6,996,461 B2 2/2006 Kane et al.
7,021,588 B2 4/2006 Hess, Jr. et al.
7,021,589 B2 4/2006 Hess, Jr. et al.
7,024,289 B2 4/2006 Kane et al.
7,036,774 B2 5/2006 Kane et al.
7,079,926 B2 7/2006 Kane et al.
7,092,800 B2 8/2006 Kane et al.
7,092,801 B2 8/2006 Kane et al.
7,096,096 B2 8/2006 Kane et al.
7,209,810 B2 4/2007 Meyer et al.
7,869,950 B2 * 1/2011 Ueda et al. ..... 701/220
2002/0059075 A1 5/2002 Schick et al.
2002/0096081 A1 7/2002 Kraft
2003/0213875 A1 11/2003 Hess, Jr. et al.
2004/0133315 A1 7/2004 Kumar et al.
2004/0245410 A1 12/2004 Kisak et al.
2005/0065674 A1 3/2005 Houpt et al.
2005/0120904 A1 6/2005 Kumar et al.
2006/0025921 A1 * 2/2006 Jung et al. ..... 701/201
2007/0219680 A1 9/2007 Kumer et al.
2009/0138199 A1 * 5/2009 Bonanni et al. ..... 701/214

* cited by examiner

SYSTEM AND METHOD FOR DETERMINING A QUALITY OF A LOCATION ESTIMATION OF A POWERED SYSTEM

BACKGROUND OF THE INVENTION

Rail vehicles, such as a train having one or more locomotives, for example, travel along a route from one location to another. Some trains travel along the route in an automatic mode, in which, prior to traveling along the route, a controller predetermines one or more train parameters, such as speed and notch setting, for example, at each location along the route. In order to predetermine the train parameter(s) at each location along the route, the controller may use a memory which prestores a characteristic of the route at each location, such as the grade, for example. While traveling along the route, it is important for the controller to be aware of the train location, to ensure that the actual train parameter(s) track the predetermined train parameter(s), at each train location. Additionally, since the route may include various train parameter restrictions, such as a speed restriction, for example, the controller needs to be aware when the train location is approaching a train parameter restriction location, so to adjust the train parameter(s), if needed, to comply with the train parameter restriction.

Alternatively, the train may travel along the route in a manual mode, in which the train operator is responsible for manually adjusting the train parameter(s). As with the automatic mode, while traveling along the route, it is important for the train operator to be aware of the train location, such as when the train location approaches a train parameter restriction location, for example. The train operator would then manually adjust the train parameter(s) to comply with a train parameter restriction.

Conventional systems have been designed to assist the controllers in the automatic mode and the train operators in the manual mode, to provide a location of the train, as the train travels along the route. However, these conventional systems rely solely on a global positioning satellite (GPS) system, which provides one measurement of the train location, based on satellite positioning or other positioning systems using wireless network or wayside equipment, for example. Upon receiving the positioning system measurement, the controller typically uses its memory to convert this raw position measurement to a distance measurement along the route.

As with any measurement system, the position measurement system is capable of error, such as if the GPS receiver of the train fails to communicate with a sufficient number of satellites, or an error in the memory of the controller which may convert an accurate raw GPS measurement to an inaccurate distance measurement along the route, for example. Accordingly, it would be advantageous to provide an independent distance measurement in addition to the GPS measurement along the route, so to ensure that the distance estimation provided to the controller or train operator is somewhat reliable. Additionally, it would be advantageous to assign a quality value to the distance estimation provided to the controller or train operator.

BRIEF DESCRIPTION OF THE INVENTION

In one embodiment of the present invention, a system is provided for determining a quality value of a location estimation of a powered system at a location. The system includes a first sensor configured to measure a first parameter of the powered system at the location. The system further includes a second sensor configured to measure a second parameter of the powered system at the location. The system further includes a second controller configured to determine the location estimation of the powered system and the quality value of the location estimation, based upon a first location of the powered system based on the first parameter, and a second location of the powered system based on the second parameter of the powered system.

In one embodiment of the present invention, a system is provided for determining a quality value of a location estimation of a powered system at a location. The system includes a speed sensor configured to determine a speed of the powered system at the location. The system further includes a position determination device configured to provide a measured position of the powered system. The system further includes a second controller configured to determine the quality value of the location estimation during a first time period when the position determination device provides the measured position of the powered system. The quality value is based on at least one of an uncertainty in the position of the powered system and an uncertainty in the speed of the powered system.

In one embodiment of the present invention, a method is provided for determining a quality value of a location estimation of a powered system at a location. The method includes measuring a speed of the powered system at the location, and measuring a position of the powered system. The method further includes determining the location estimation of the powered system and the quality value of the location estimation. The step of determining the location estimation and quality value of the location estimation is based upon a first location of the powered system based on the speed, and a second location of the powered system based on the measured position of the powered system.

BRIEF DESCRIPTION OF THE DRAWINGS

A more particular description of the embodiments of the invention briefly described above will be rendered by reference to specific embodiments thereof that are illustrated in the appended drawings. Understanding that these drawings depict only typical embodiments of the invention and are not therefore to be considered to be limiting of its scope, the embodiments of the invention will be described and explained with additional specificity and detail through the use of the accompanying drawings in which.

DETAILED DESCRIPTION OF THE INVENTION

Figure 1:
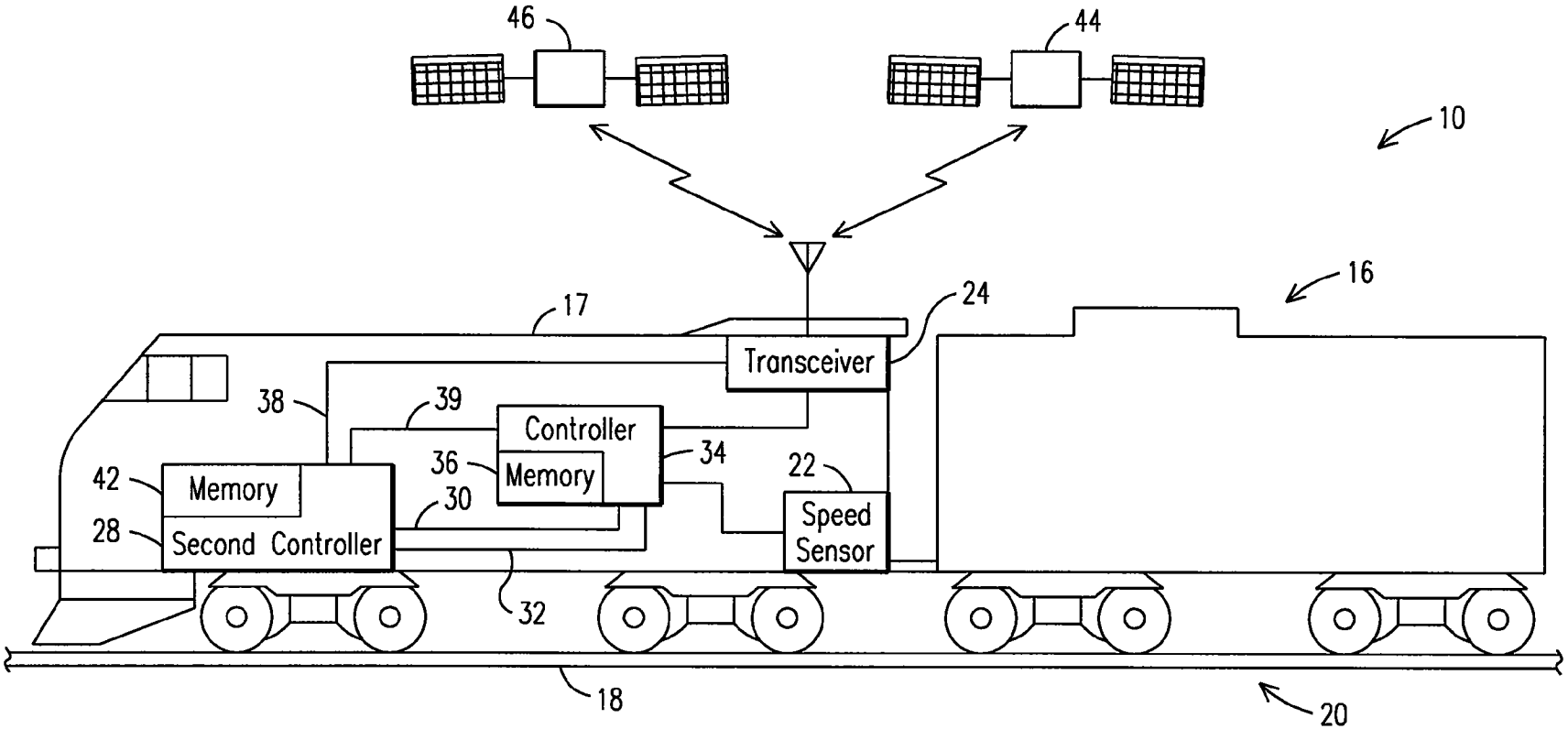
FIG. 1 is a side plan view of an exemplary embodiment of a system for determining a quality value of a distance estimation of a rail vehicle at a location along a route.

In describing particular features of different embodiments of the present invention, number references will be utilized in relation to the figures accompanying the specification. Similar or identical number references in different figures may be utilized to indicate similar or identical components among different embodiments of the present invention.

Though exemplary embodiments of the present invention are described with respect to rail vehicles, or railway transportation systems, specifically trains and locomotives having diesel engines, exemplary embodiments of the invention are also applicable for other uses, such as but not limited to off-highway vehicles, marine vessels, stationary units, and, agricultural vehicles, transport buses, each which may use at least one diesel engine, or diesel internal combustion engine. Towards this end, when discussing a specified mission, this includes a task or requirement to be performed by the diesel powered system. Therefore, with respect to railway, marine, transport vehicles, agricultural vehicles, or off-highway vehicle applications this may refer to the movement of the system from a present location to a destination. In the case of stationary applications, such as but not limited to a stationary power generating station or network of power generating stations, a specified mission may refer to an amount of wattage (e.g., MW/hr) or other parameter or requirement to be satisfied by the diesel powered system. Likewise, an operating condition of the diesel-fueled power generating unit may include one or more of speed, load, fueling value, timing, etc. Furthermore, though diesel powered systems are disclosed, those skilled in the art will readily recognize that an embodiment of the invention may also be utilized with non-diesel powered systems, such as but not limited to natural gas powered systems, bio-diesel powered systems, etc. Furthermore, as disclosed herein such non-diesel powered systems, as well as diesel powered systems, may include multiple engines, other power sources, and/or additional power sources, such as, but not limited to, battery sources, voltage sources (such as but not limited to capacitors), chemical sources, pressure-based sources (such as but not limited to spring and/or hydraulic expansion), current sources (such as but not limited to inductors), inertial sources (such as but not limited to flywheel devices), gravitational-based power sources, and/or thermal-based power sources.

In one exemplary example involving marine vessels, a plurality of tugs may be operating together where all are moving the same larger vessel, where each tug is linked in time to accomplish the mission of moving the larger vessel. In another exemplary example a single marine vessel may have a plurality of engines. Off Highway Vehicles (OHV) may involve a fleet of vehicles that have a same mission to move earth, from location A to location B, where each OHV is linked in time to accomplish the mission. With respect to a stationary power generating station, a plurality of stations may be grouped together collectively generating power for a specific location and/or purpose. In another exemplary embodiment, a single station is provided, but with a plurality of generators making up the single station. In one exemplary example involving locomotive vehicles, a plurality of diesel powered systems may be operating together where all are moving the same larger load, where each system is linked in time to accomplish the mission of moving the larger load. In another exemplary embodiment a locomotive vehicle may have more than one diesel powered system.

Figure 2:
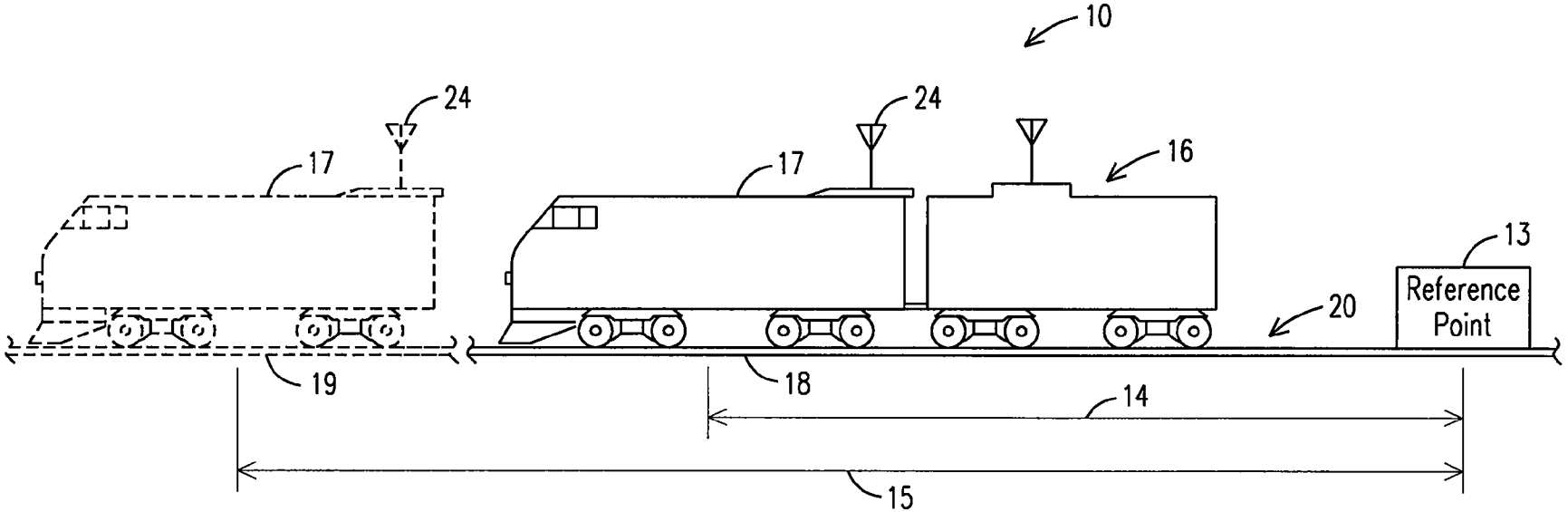
FIG. 2 is a side plan view of an exemplary embodiment of a system for determining a quality value of a distance estimation of a rail vehicle at a plurality of locations along a route.

FIGS. 1-2 illustrates an exemplary embodiment of a system 10 for determining a quality value 12 (FIGS. 3 and 5) of a distance estimation 14 of a rail vehicle, such as a train 16 including a locomotive 17, for example, at a location 18 along a route 20. The distance estimation 14 is based on a reference point 13 along the route 20, such as a destination location of a trip, a city boundary, a milestone, a wayside device, or any similar reference point. Although the reference point 13 in FIG. 1 is a previous location along the route 20, the reference point may be a future location along the route, for example. Although the illustrated embodiments of FIGS. 1-7 illustrate a system for determining a quality value of a distance estimation of a rail vehicle, such as a train, along a route, the embodiments of the present invention may be employed for any powered system, such as off-highway vehicles (OHV), marine vehicles, in addition to other applications, for example, which do not travel along a rail. The embodiments of the present invention may be employed to determine a location estimation and a respective quality value of the location estimation for these powered systems, as the powered systems do not necessarily follow a prescribed distance along a predetermined route, as with a rail vehicle, for example.

The system 10 includes a speed sensor 22 positioned on the locomotive 17 to measure a speed of the train 16 at the location 18 along the route 20. The speed sensor may be any type of conventional speed sensor used to measure the speed of a locomotive, as appreciated by one of skill in the art. The system 10 further includes a controller 34 coupled to the speed sensor 22. The controller 34 determines a first distance 30 of the train 16 from the reference point 13 along the route 20 based on the speed of the train 16 from the reference point 13 to the location 18 along the route 20. As will be appreciated by one of skill in the art, the controller 34 integrates the speed of the train 16 over the time period that the train 16 travels between the reference point 13 and the location 18, to determine the first distance 30. Although the speed sensor 22 illustrated in FIG. 1 is configured to send speed data to the controller 34, and the controller 34 calculates the first distance 30, speed sensors may be utilized in the exemplary embodiment of the present invention which internally calculate the first distance 30, and subsequently transmits the first distance to a second controller, as discussed below. In addition to the measured speed, the speed sensor 22 outputs an uncertainty signal 39 to the controller 34, which is subsequently transmitted to a second controller (see below) for determining the third quality value 12 of the distance estimation 14. The uncertainty signal 39 is indicative of a level of uncertainty in the measured speed of the train 16, and in addition to being a tunable constant, the uncertainty signal 39 may come directly from the speed sensor 22 to the second controller 28, for example.

The system 10 further includes a position determination device, such as a transceiver 24, for example, to provide a measured position of the train 16. In an exemplary embodiment, the transceiver 24 is a global positioning satellite (GPS) device configured to communicate with a plurality of global positioning satellites 44,46, for example. Although FIG. 1 illustrates a pair of global positioning satellites 44,46, the transceiver 24 may be configured to communicate with more than two global positioning satellites, for example. Additionally, in contrast with the first distance 30 of the train 16 from the reference point 13 to the location 18 along the route 20, the measured position is a raw position of the train 16, based on latitude/longitude, for example, and thus does not correlate with a distance from the reference point 13 along the route 20.

Although FIG. 1 illustrates one transceiver 24 (i.e., one position determination device), more than one position determination device, such as two or more GPS sensors, wayside equipment, a locomotive operator manual input (upon recognizing a milepost, for example), and any combination thereof. Additionally, although the train 16 illustrated in FIG. 1 includes one locomotive, more than one locomotive may be included on a train, and each locomotive may utilize one or more of the above-mentioned position determination device(s) to determine a distance estimation and a quality value of a respective distance estimation to each locomotive. By utilizing more than one position determination device, a more accurate distance estimation and quality value of the distance estimation may be achieved. For example, if ten position determination devices were utilized and provide distances in the range of 21.3-21.4 miles, a relatively good quality value would accompany a distance estimation in that range. However, if merely two position determination devices were utilized and provide distances of 25 and 30 miles, a relatively bad quality value would accompany a distance estimation based on these distances. In an exemplary embodiment, in determining the distance estimation 14, a second controller (see below) may compute an average or a standard deviation of a plurality of distances provided from a plurality of position determination devices. For example, if ten position determination devices provide ten distances with an average of 21.3 miles, this may be used as the distance estimation. However, the second controller may evaluate the standard deviation of these ten distances, which for example may range between 18-27 miles, and thus, may base the quality value of the distance estimation on the standard deviation.

The controller 34 is coupled to the transceiver 24. The controller 34 converts the measured position of the train 16 into a second distance 32 of the train 16 along the route 20 based on a memory 36 of the controller 34 which stores the second distance 32 of the train 16 along the route 20, based on the measured position. Thus, the memory 36 effectively stores a list of the measured positions (in terms of latitude/longitude) for the entire route 20, and the distance of each measured position from the particular reference point 13 along the route 20. Although the transceiver 24 illustrated in FIG. 1 transmits a measured position to the controller 34 which is subsequently converted to the second distance 32 from the reference point 13 along the route 20, the transceiver may include an internal memory similar to the memory 36 of the controller 34 which performs this conversion. In addition to the measured position, the transceiver 24 outputs an uncertainty signal 38 to a second controller (see below) for determining the third quality value 12 of the distance estimation 14. The uncertainty signal 38 is indicative of a level of uncertainty in the measured position of the train 16, and may be reflective of the number of global positioning satellites 44,46 in sufficient communication with the transceiver, for example. The uncertainty signal 38 may be a dilution of precision (DOP) value, which is a unitless value between 1 and 5, as appreciated by one of skill in the art, where a higher number if indicative of greater uncertainty in the measured position of the train 16.

The system 10 further includes a second controller 28, which is configured to determine the distance estimation 14 of the train 16 at the location 18 along the route 20, and the third quality value 12 of the distance estimation 14 of the train 16 at the location 18 along the route 20. As illustrated in FIG. 1, the second controller 28 determines the distance estimation 14 and the third quality value 12 of the distance estimation based upon the four inputs of the first distance 30 of the train 16 along the route 20 based on the train speed, the second distance 32 of the train 16 along the route 20 based on the measured position of the train 16, the uncertainty signal 39 provided from the speed sensor 22, and the uncertainty signal 38 provided from the transceiver 24. Although FIG. 1 illustrates that the second controller 28 bases its determination of the distance estimation 14 and the third quality value 12 of the distance estimation 14 based on the four inputs of the first distance 30, the second distance 32, the uncertainty signal 39 and the uncertainty signal 38, the second controller 28 may base its determination of the distance estimation 14 and the third quality value 12 based on less than or more than these four inputs. In one exemplary embodiment, the second controller is a kalman filter, for example.

As further illustrated in the exemplary embodiment of FIG. 1, the second controller 28 includes a memory 42. The memory 42 stores prior distance estimations and respective prior quality values for previous locations from the location 18 along the route 20. As illustrated in the exemplary embodiments of FIGS. 3-4, which are time plots of the first and third quality values 11 (FIG. 3), 12 (FIG. 5) of the distance estimation 14 over time (where time is represented by horizontal axes 202 and 402 in FIGS. 3 and 5), during a first time period 40 (approximately t=2500-3000 in FIGS. 3 and 5), the transceiver 24 provides a measured position of the train 16. During this first time period 40, the second controller 28 determines the first and third quality values 11, 12 of distance estimation 14 based on the first distance 30, the second distance 32, the uncertainty signal 38, and the prior quality values provided from the second controller memory 42. Although the exemplary embodiment of the present invention involves the second controller 28 determining the first and third quality values 11, 12 based on the first distance 30, the second distance 32, the uncertainty signal 38, and the prior quality values, the second controller 28 may determine the first and third quality values 11, 12 based on less or more than these values. The third quality value 12 of the exemplary embodiment of FIG. 5 (as shown alongside a vertical axis 400 which is measured in feet) is based on the absolute value of the first quality value 11 of the exemplary embodiment of FIG. 3 (as represented along a vertical axis 200), with the exception of a second time period 48 when the transceiver 24 fails to provide a measured position of the train 16 (discussed below). As an example, if at a time $t_1$=2600 during the first time period 40, the first distance 30 is 100 feet, the second distance 32 is 95 feet, the uncertainty signal 38 is 4 (high), and a prior quality value before $t_1$ was 3 feet, the second controller 28 may determine that the third quality value 12 is 4 feet. Since the uncertainty signal 38 was high, the second controller 28 will likely increase the third quality value 12 from its prior value of 3 feet, to the value of 4 feet. Thus, the second controller 28 essentially continuously propagates the third quality value 12, based on the uncertainty signal 38, the first distance 30, the second distance 32 and the prior quality value(s). Also, the second controller 28 computes the distance estimation 14 by adding the third quality value 12 to the second distance 32 (if the second distance 32 is less than the first distance 30), or by subtracting the third quality value 12 from the second distance 32 (if the second distance 32 is greater than the first distance 30). In this example, the second distance 32 is less than the first distance 30, so the second controller 28 adds the third quality value 12 to the second distance 32 to arrive at the distance estimation 14: 95 feet+4 feet=99 feet. To continue this example, at a second time $t_2$=2800 during the first time period 40, the first distance 30 is 250 feet, the second distance 32 is 240 feet, the uncertainty signal 38 is 2 (low), and the previous third quality value 12 was 3 feet, as previously computed. Since the uncertainty signal 38 is low, the second controller 28 will likely decrease the third quality value 12 from its prior value of 4 feet, to the value of 3 feet, for example. Additionally, the second controller 28 will compute the distance estimation 15 (FIG. 2) of the train 16 at the later time $t_2$ to be the sum of the second distance 32 and the new third quality value 12: 240 feet+3 feet=243 feet. FIG. 2 illustrates the distance estimations 14,15 of the train 16 at the respective time instants $t_1$,$t_2$. The numeric distances in the above example are merely exemplary, and thus the second controller 28 may determine the same or different values as those above.

As will be appreciated by one of skill in the art, the speed sensor 22 continuously measures the speed of the locomotive 17, continuously provides the speed information to the controller 34 and thus the second controller 28 receives first distance 30 data on a continuous time interval basis. However, the transceiver 24 does not routinely provide continuous measured positions of the train 16, but instead provides these measured positions at diluted time intervals, based on the availability of the satellite signals, in addition to other factors, for example. Thus, the second controller 28 receives the second distance 32 data from the controller 34 on a diluted time interval basis. Based on the difference in the continuous and diluted time intervals of the respective first and second distance 30,32 data provided to the second controller 28, the second controller 28 dynamically determines the third quality value 12 of the distance estimations on a diluted time interval basis, which effectively acts as a correction to the first distance 30 provided on the continuous time interval basis.

Figure 3:
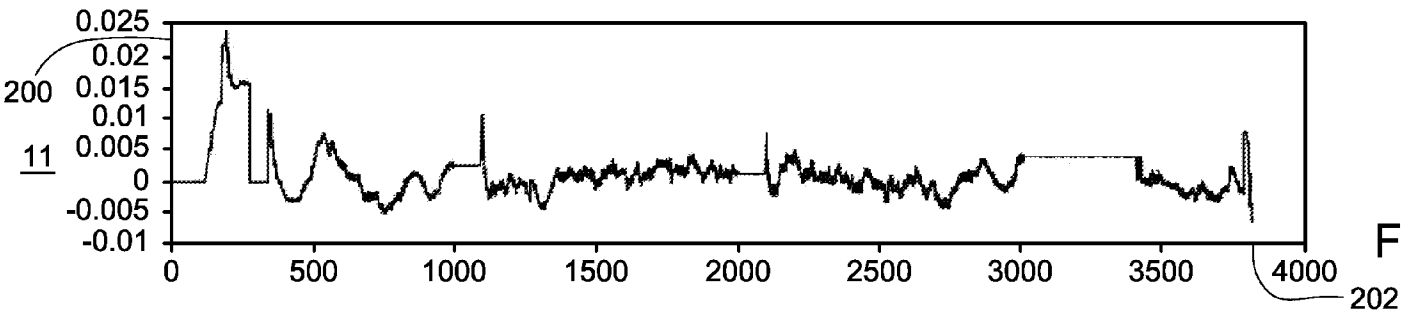
FIG. 3 is a plot of an exemplary embodiment a first quality value of a distance estimation of the rail vehicle at a plurality of locations along a route.
Figure 5:
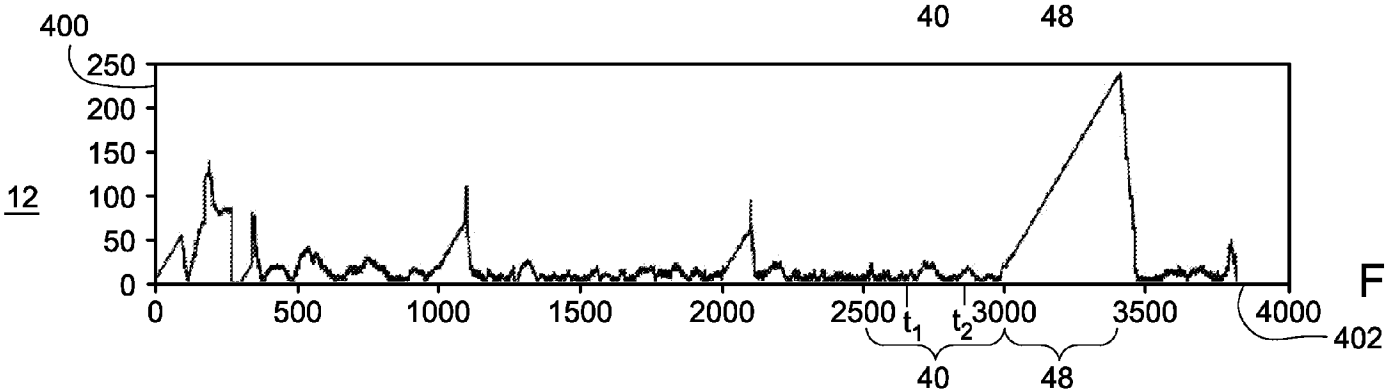
FIG. 5 is a plot of an exemplary embodiment a third quality value of a distance estimation of the rail vehicle at a plurality of locations along a route.

As further illustrated in the exemplary embodiment of FIGS. 3 and 5, during a second time period 48 (approximately t=3000-3500), the transceiver 24 ceases to provide the measured position of the train 16. To determine if the transceiver 24 has ceased to provide a measured position of the train 16, the controller 34 compares the first distance 30 and the second distance 32 to determine a precision of the second distance 32 relative to the first distance 30, and further to determine if the precision falls below a threshold level for a threshold period of time. If the controller 34 determines that the transceiver 24 has ceased to provide any measured position, or that the measured position is not adequately precise, the controller sends a signal to the second controller 28 to modify its method of computing the third quality value 12 of the distance estimation 14, as discussed below. During the second time period 48, the first quality value 11 in FIG. 3 is essentially flat, as in this particular embodiment, the second controller 28 essentially equates the current quality value with the prior quality value. However, for the third quality value 12 of the distance estimation 14 in the embodiment of FIG. 5, the second controller 28 determines an increase in the third quality value 12 based on a quality value prior to the transceiver 24 having ceased to provide a measured position of the train 16, and a pair of configurable constants K1,K2, based on an uncertainty in the speed of the train 16, as follows:

$$\text{Quality Value Increase } (t) = K2 * \text{Previous Quality Value} * t + K1 * t$$

Accordingly, during the initial portion of the second time period 48 in FIG. 5, the third quality value 12 essentially is an increasing line having a slope based on the product of the previous quality value prior to the transceiver 24 having ceased to provide a measured position and a configurable constant K2, based on the speed uncertainty. During the second time period 48, when the transceiver 24 has started to communicate back with the controller 34, the second controller 28 determines a decrease in the third quality value 12 based on the previous quality value prior the transceiver 24 starting to communicate back to provide a measured position of the train 16 and a skew based on the uncertainty signal 38, as follows:

$$\text{Quality Value Decrease } (t) = \text{Previous Quality Value} + \text{skew (based on uncertainty signal)}$$

Accordingly, the lower the uncertainty signal 38 value that is provided from the transceiver 24, the greater the decrease in the quality value back down to the range of quality values prior to the transceiver 24 having ceased to provide the measured position. As will be appreciated by those of skill in the art, the third quality value 12 increases once the transceiver 24 ceases to provide a measured position since only one distance measurement (speed) is being utilized, and the GPS distance measurement will not be relied upon significantly until the uncertainty signal 38 is once again relatively low.

Figure 6:
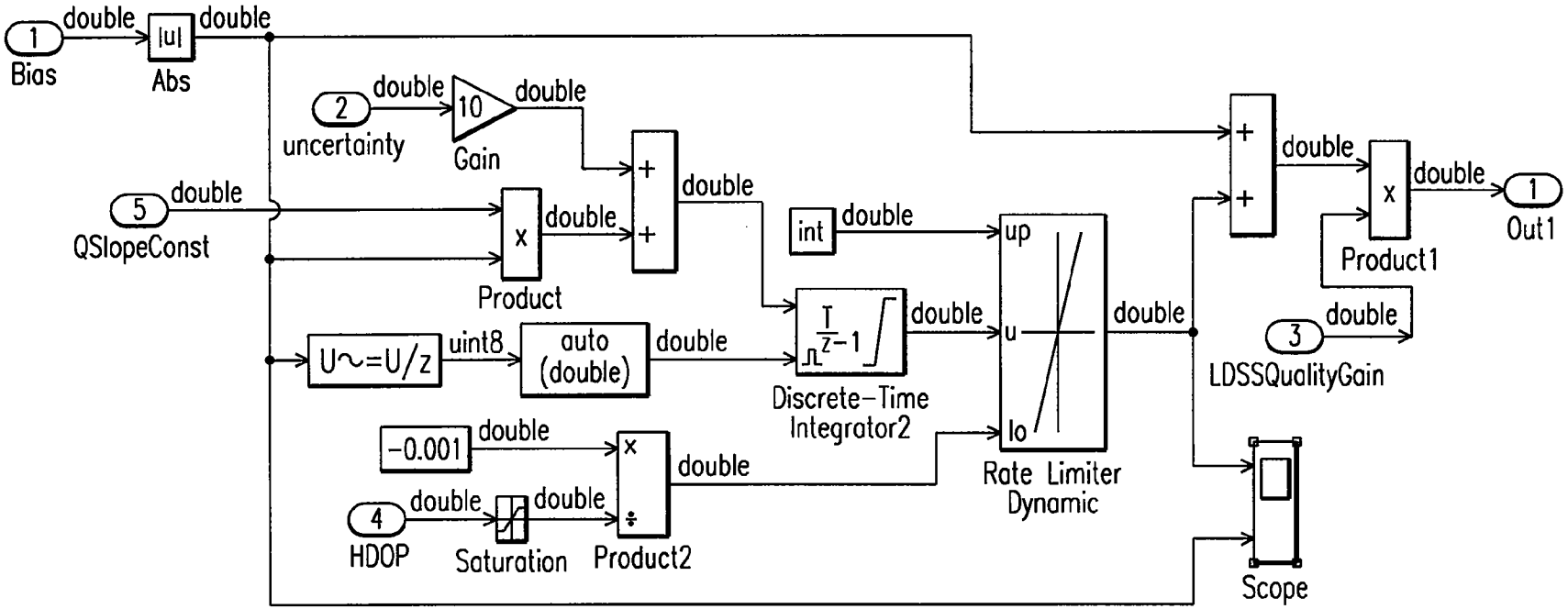
FIG. 6 is a block diagram of an exemplary embodiment of a second controller configured to determine a quality value of a distance estimation of a rail vehicle at a plurality of locations along a route.

The controller 34 is switchable to an automatic mode. In the automatic mode, the controller 34 determines an initial parameter of the train 16 for each location along the route 20 prior to the train 16 commencing a trip along the route 20. In the automatic mode, the controller 34 utilizes the distance estimation 14 and the third quality value 12 of the distance estimation to adjust the initial parameter at an upcoming location 19 (FIG. 2) to a modified parameter for the upcoming location 19 (FIG. 2) along the route 20. For example, the controller 34 in the automatic mode may use the distance estimation 14 and third quality value 12 at the initial location 18, in a worse case scenario, when determining whether to modify an initial parameter planned for the upcoming location 19. For example, if the third quality value 12 of the distance estimation 14 was 10 feet, then the controller 34 may plan to reset the initial parameter at the upcoming location 19 to a location 10 feet short of the upcoming location 19, depending on the importance of setting the initial parameter at the upcoming location 19. Additionally, the controller 34 may utilize the distance estimation 15 of the upcoming location 19 to confirm when the train 16 is actually at the upcoming location 19 to track the accuracy of the initial parameter at the upcoming location 19. More specifically, in an exemplary embodiment, if the initial parameter is the speed of the train 16, the distance estimation 14 and the third quality value 12 of the distance estimation may be utilized to adjust the initial speed parameter of the train to a modified speed parameter at a distance prior to the upcoming location 19 of the train (where the third quality value 12 may be used to determine the distance prior to the upcoming location 19), to comply with a speed restriction at the upcoming location 19 along the route 20. The controller 34 is switchable from the automatic mode to a manual mode, in which a train operator determines the initial parameter of the train at each location along the route. The controller 34 is configured to switch from the automatic mode to the manual mode upon the third quality value 12 being outside a predetermined acceptable range stored in the memory 36 of the controller 34. FIG. 6 illustrates an exemplary embodiment of a block diagram of the internal operations of the second controller 28, for example. FIG. 6 is merely an example of one block diagram arrangement of the second controller 28, and thus various other block diagram arrangements are possible.

Figure 7:
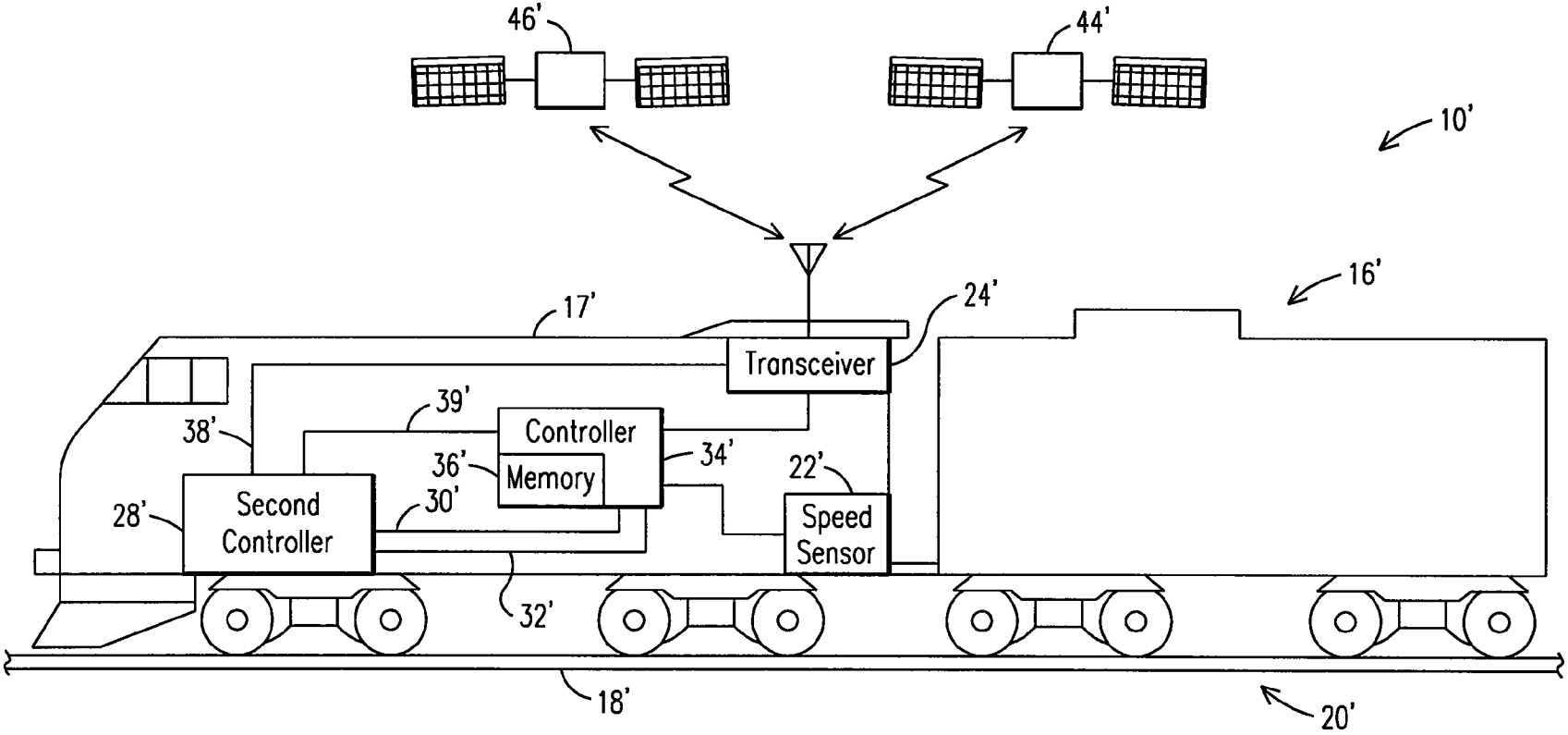
FIG. 7 is a side plan view of an exemplary embodiment of a system for determining a quality value of a distance estimation of a rail vehicle at a location along a route.

FIG. 7 illustrates an additional embodiment of a system 10' for determining a second quality value 12' (FIG. 4) of a distance estimation of a train 16' at a location 18' along a route 20'. The second quality value 12' is shown alongside a horizontal axis 302 representative of time and a vertical axis 300 representative of the values of the second quality value 12' in feet. The system 10' includes a speed sensor 22' to determine a speed of the train 16' at the location 18' along the route 20'.

Figure 4:
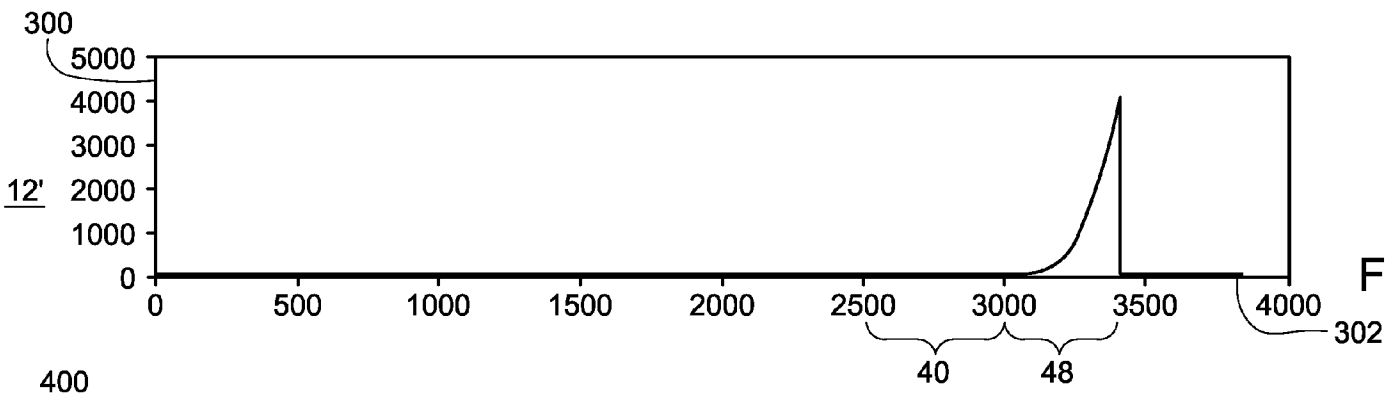
FIG. 4 is a plot of an exemplary embodiment a second quality value of a distance estimation of the rail vehicle at a plurality of locations along a route.

The system 10' further includes a transceiver 24' to measure a position of the train 16'. The system 10' further includes a second controller 28' to determine the second quality value 12' of the distance estimation during a first time period 40' when the transceiver 24' measures the position of the train 16'. As illustrated in the plot of FIG. 4 and FIG. 7, the second quality value 12' is based on the uncertainty signal 38' and an uncertainty signal 39' in the speed of the train 16'. Although the exemplary embodiment describes that the second quality value 12' is based on the sum of the uncertainties in the measured position and the speed, the second quality value 12' may be based on only one of these uncertainties. As shown in the plot of FIG. 4 during the second time period 48, since the second quality value 12' is based on the sum of the uncertainties in the speed and the measured position, the second quality value 12' continuously increases to a large number (approx 4000 feet), however other versions of the system 10' may be adjusted such that the second quality value 12' does not continuously increase to such large amounts. The second controller 28' is configured to determine the distance estimation based upon the first distance 30', the second distance 32', and the second quality value 12' of the distance estimation.

Figure 8:
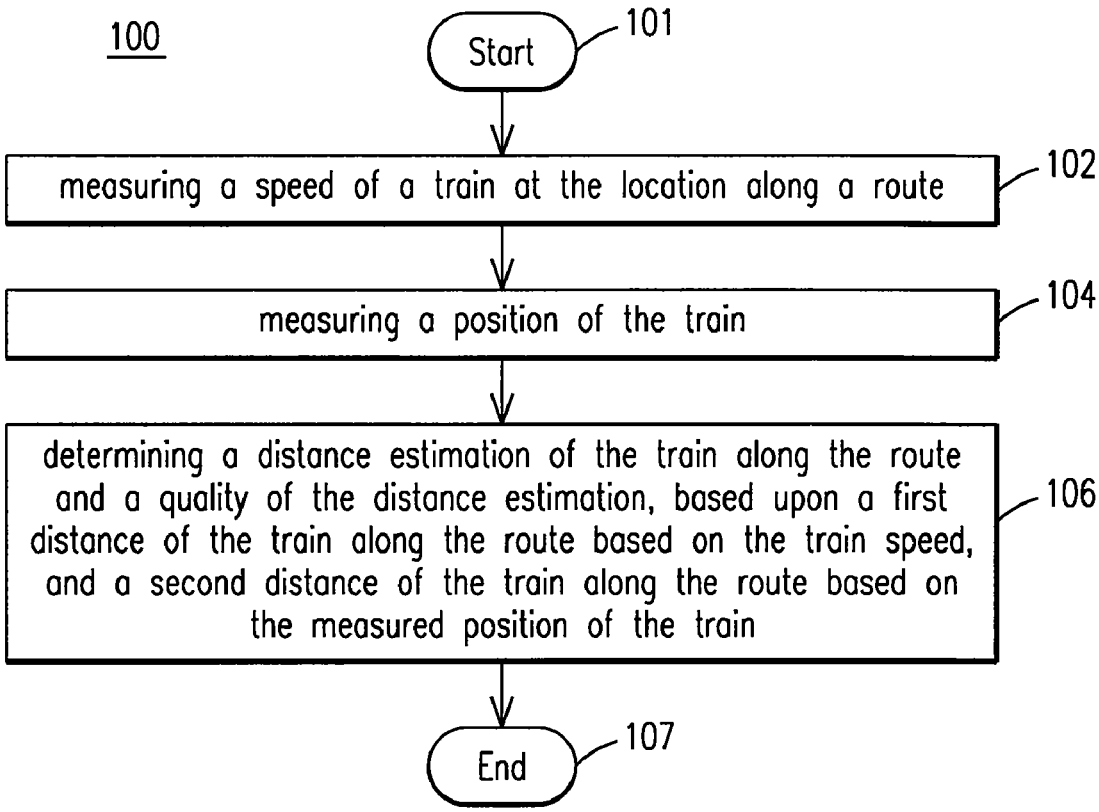
FIG. 8 is a flow chart illustrating an exemplary embodiment of a method for determining a quality value of a distance estimation of a rail vehicle at a location along a route.

FIG. 8 illustrates a flow chart of an exemplary embodiment of a method 100 for determining a quality value 12 of a distance estimation 14 of a train 16 at a location 18 along a route 20. The method 100 begins at 101 by measuring 102 a speed of the train 16 at the location 18 along the route 20. The method 100 further includes measuring 104 a position of the train 16. The method 100 further includes determining 106 the distance estimation 14 of the train 16 along the route 20 and the quality value 12 of the distance estimation, based upon a first distance 30 of the train 16 along the route 20 based on the train speed, and a second distance 32 of the train 16 along the route 20 based on the measured position of the train 16, before ending at 107.

This written description uses examples to disclose embodiments of the invention, including the best mode, and also to enable any person skilled in the art to make and use the embodiments of the invention. The patentable scope of the embodiments of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

That which is claimed is:

1. A system comprising:

a first sensor configured to determine a first distance estimation of a powered system at a location based on a speed of the powered system;

a second sensor configured to determine a measured position of the powered system at the location; and at least one controller configured to determine a location estimation of the powered system and a quality value of the location estimation, and the quality value of the location estimation is based at least in part on the distance estimation and the measured position of the powered system, wherein the powered system is a rail vehicle having a plurality of locomotives with at least two of the locomotives including at least one of the first sensor, at least one of the second sensor, and the at least one controller.

2. The system of claim 1, wherein the quality value of the location estimation represents a potential inaccuracy of the location estimation.

3. The system of claim 1, wherein the at least one controller is configured to determine one or more corrections to the first distance estimation based on the measured position from the second sensor and the quality value.

4. The system of claim 1, wherein the second sensor is configured to periodically provide the measured position to the at least one controller.

5. The system of claim 1, wherein the at least one controller is configured to automatically control one or more operations of the powered system based on at least one of the location estimation or the quality value.

6. A system comprising:

a first sensor configured to determine a first distance estimation of a powered system at a location based on a speed of the powered system;

a second sensor configured to determine a measured position of the powered system at the location; and at least one controller configured to determine a location estimation of the powered system and a quality value of the location estimation, and the quality value of the location estimation is based at least in part on the distance estimation and the measured position of the powered system, wherein the at least one controller is configured to determine the first distance estimation of the powered system based on the speed of the powered system prior to the powered system reaching the location.

7. A system comprising:

a first sensor configured to determine a first distance estimation of a powered system at a location based on a speed of the powered system;

a second sensor configured to determine a measured position of the powered system at the location; and at least one controller configured to determine a location estimation of the powered system and a quality value of the location estimation, and the quality value of the location estimation is based at least in part on the distance estimation and the measured position of the powered system, wherein the at least one controller is configured to be coupled to the second sensor, the controller configured to convert the measured position of the powered system into a second distance estimation of the powered system along a route from a reference point along the route based on one or more previously acquired measured positions and corresponding distances from the reference point along the route.

8. A system comprising:

a first sensor configured to determine a first distance estimation of a powered system at a location based on a speed of the powered system;

a second sensor configured to determine a measured position of the powered system at the location; and at least one controller configured to determine a location estimation of the powered system and a quality value of the location estimation, and the quality value of the location estimation is based at least in part on the distance estimation and the measured position of the powered system, wherein: at least one of the first sensor is configured to transmit a first uncertainty signal or the second sensor is configured to transmit a second uncertainty signal to the at least one controller, at least one of the first uncertainty signal or the second uncertainty signal being indicative of a level of uncertainty in the speed or the measured position of the powered system.

9. The system of claim 8, wherein the at least one controller is configured to determine the quality value of the location estimation based on at least one of the first uncertainty signal or the second uncertainty signal.

10. A system comprising:

a first sensor configured to determine a first distance estimation of a powered system at a location based on a speed of the powered system;

a second sensor configured to determine a measured position of the powered system at the location; and at least one controller configured to determine a location estimation of the powered system and a quality value of the location estimation, and the quality value of the location estimation is based at least in part on the distance estimation and the measured position of the powered system, wherein the at least one controller is configured to determine the quality value of the location estimation based on one or more previously acquired quality values.

11. A system comprising:

a first sensor configured to determine a first distance estimation of a powered system at a location based on a speed of the powered system;

a second sensor configured to determine a measured position of the powered system at the location; and at least one controller configured to determine a location estimation of the powered system and a quality value of the location estimation, and the quality value of the location estimation is based at least in part on the distance estimation and the measured position of the powered system, wherein the second sensor is at least one global positioning system (GPS) device configured to communicate with one or more global positioning satellites.

12. A system comprising:

a first sensor configured to determine a first distance estimation of a powered system at a location based on a speed of the powered system;

a second sensor configured to determine a measured position of the powered system at the location; and at least one controller configured to determine a location estimation of the powered system and a quality value of the location estimation, and the quality value of the location estimation is based at least in part on the distance estimation and the measured position of the powered system, wherein the location estimation of the powered system at the location is based on at least one of a sum of or difference between the quality value of the location estimation and at least one of the first distance estimation or the measured position.

13. A system comprising:

a first sensor configured to determine a first distance estimation of a powered system at a location based on a speed of the powered system;

a second sensor configured to determine a measured position of the powered system at the location; and at least one controller configured to determine a location estimation of the powered system and a quality value of the location estimation, and the quality value of the location estimation is based at least in part on the distance estimation and the measured position of the powered system, wherein the at least one controller is configured to receive the first distance estimation from the first sensor more frequently than the at least one controller receives the measured position from the second sensor.

14. A system comprising:

a first sensor configured to determine a first distance estimation of a powered system at a location based on a speed of the powered system;

a second sensor configured to determine a measured position of the powered system at the location; and at least one controller configured to determine a location estimation of the powered system and a quality value of the location estimation, and the quality value of the location estimation is based at least in part on the distance estimation and the measured position of the powered system, wherein the second sensor is configured to periodically provide the measured position to the at least one controller and the at least one controller is configured to determine the quality value based on a prior quality value that is determined between the measured positions that are periodically provided by the second sensor.

15. A system comprising:

a first sensor configured to determine a first distance estimation of a powered system at a location based on a speed of the powered system;

a second sensor configured to determine a measured position of the powered system at the location; and at least one controller configured to determine a location estimation of the powered system and a quality value of the location estimation, and the quality value of the location estimation is based at least in part on the distance estimation and the measured position of the powered system, wherein the at least one controller is configured to increase the quality value when the second sensor fails to provide the measured position of the powered system to the at least one controller.

16. A system comprising:

a first sensor configured to determine a first distance estimation of a powered system at a location based on a speed of the powered system;

a second sensor configured to determine a measured position of the powered system at the location; and at least one controller configured to determine a location estimation of the powered system and a quality value of the location estimation, and the quality value of the location estimation is based at least in part on the distance estimation and the measured position of the powered system, wherein the at least one controller is configured to compare the first distance estimation and the measured position to determine a precision of the measured position relative to the first distance estimation.

17. The system of claim 16, wherein the at least one controller is configured to determine the quality value based on a prior quality value when the precision falls below a threshold level.

18. A system comprising:

a first sensor configured to determine a first distance estimation of a powered system at a location based on a speed of the powered system;

a second sensor configured to determine a measured position of the powered system at the location; and at least one controller configured to determine a location estimation of the powered system and a quality value of the location estimation, and the quality value of the location estimation is based at least in part on the distance estimation and the measured position of the powered system, wherein the at least one controller is configured to determine a parameter of the powered system for one or more of the locations along a route traveled by the powered system based on at least one of the location estimation or the quality value.

19. The system of claim 18, wherein the at least one controller is configured to adjust the parameter of the powered system to a modified parameter for an upcoming location of the powered system along the route.

20. The system of claim 18, wherein the parameter is the speed of the powered system; and the at least one controller is configured to adjust the speed of the powered system based on at least one of the location estimation or the quality value.

21. A system comprising:

a first sensor configured to determine a first distance estimation of a powered system at a location based on a speed of the powered system;

a second sensor configured to determine a measured position of the powered system at the location; and at least one controller configured to determine a location estimation of the powered system and a quality value of the location estimation, and the quality value of the location estimation is based at least in part on the distance estimation and the measured position of the powered system, wherein the at least one controller is configured to automatically control one or more operations of the powered system based on at least one of the location estimation or the quality value and the at least one controller is configured to switch from automatically controlling the one or more operations of the powered system to manual control of the one or more operations by an operator when the quality value is outside a predetermined range.

22. A system comprising:

a speed sensor configured to determine a speed of a powered system at a location;

a position determination device configured to provide a measured position of the powered system; and at least one controller configured to determine a quality value of a location estimation of the powered system that is based on the speed of the powered system and the measured position of the powered system, wherein the quality value also is based at least in part on at least one of an uncertainty in the speed of the powered system or an uncertainty in the measured position of the powered system, wherein at least one of the position determination device is configured to transmit a position uncertainty signal to the at least one controller or the speed sensor is configured to transmit a speed uncertainty signal to the at least one controller, and the at least one controller is configured to determine the quality value based on at least one of the position uncertainty signal or the speed uncertainty signal.

23. The system of claim 22, wherein the powered system is a rail vehicle traveling along a route and the location estimation is a distance estimation of the rail vehicle from a reference point along the route.

24. The system of claim 22, wherein one or more of the at least one controller is configured to determine the location estimation of the powered system based upon a first distance estimation of the powered system from a reference point along the route that is determined based on the speed of the powered system, a second distance estimation of the powered system along the route from the reference point based on the measured position of the powered system, and the quality value.

25. The system of claim 22, wherein the quality value of the location estimation represents a potential inaccuracy of the location estimation.

26. A system comprising:

a speed sensor configured to determine a speed of a powered system at a location;

a position determination device configured to provide a measured position of the powered system; and at least one controller configured to determine a quality value of a location estimation of the powered system that is based on the speed of the powered system and the measured position of the powered system, wherein the quality value also is based at least in part on at least one of an uncertainty in the speed of the powered system or an uncertainty in the measured position of the powered system, wherein the at least one controller determines the quality value based on an uncertainty in the speed of the powered system when the position determination device fails to provide the measured position of the powered system.

27. A system comprising:

a first sensor configured to determine a first distance estimation of a powered system at a location based on a speed of the powered system;

a second sensor configured to determine a measured position of the powered system at the location; and at least one controller configured to determine a location estimation of the powered system and a quality value of the location estimation, and the quality value of the location estimation is based at least in part on the distance estimation and the measured position of the powered system, wherein the at least one controller is configured to reduce the quality value when the second sensor provides the measured position to the at least one controller.

* * * * *